US011802663B2

(12) United States Patent
Corcoles-Gonzalez et al.

(10) Patent No.: US 11,802,663 B2
(45) Date of Patent: Oct. 31, 2023

(54) MULTIPLE CRYOGENIC SYSTEMS SECTIONED WITHIN A COMMON VACUUM SPACE

(71) Applicant: International Business Machines Corporation, Armonk, NY (US)

(72) Inventors: Antonio Corcoles-Gonzalez, Mount Kisco, NY (US); Patryk Gumann, Tarrytown, NY (US); Jerry M. Chow, Scarsdale, NY (US)

(73) Assignee: International Business Machines Corporation, Armonk, NY (US)

( * ) Notice: Subject to any disclaimer, the term of this patent is extended or adjusted under 35 U.S.C. 154(b) by 216 days.

(21) Appl. No.: 17/144,964

(22) Filed: Jan. 8, 2021

(65) Prior Publication Data

US 2022/0221108 A1 Jul. 14, 2022

(51) Int. Cl.
*F17C 3/08* (2006.01)

(52) U.S. Cl.
CPC ..... *F17C 3/085* (2013.01); *F17C 2203/0391* (2013.01)

(58) Field of Classification Search
CPC .... F17C 3/085; F17C 2203/0391; F25B 9/12; F25B 9/10; F25D 19/006
See application file for complete search history.

(56) References Cited

U.S. PATENT DOCUMENTS 3,638,440 A * 2/1972 Lawless ..... F25B 21/00 62/3.1
2008/0148756 A1 6/2008 Oomen et al.
2019/0383525 A1* 12/2019 Matthews ..... F25B 9/10
2020/0363014 A1 11/2020 Hart et al.

FOREIGN PATENT DOCUMENTS

CN 111981724 A * 11/2020 ..... F25B 23/00
EP 3 584 516 A1 12/2019

OTHER PUBLICATIONS

International Search Report and Written Opinion received for International PCT Application Serial No. PCT/EP2022/050127 dated Apr. 25, 2022, 12 pages.
Devlin et al., "A High Capacity Completely Closed-cycle 250 mK 3He Refrigeration System Based on a Pulse Tube Cooler", Cryogenics, vol. 44, 2004, pp. 611-616.

* cited by examiner

*Primary Examiner* — Emmanuel E Duke
(74) *Attorney, Agent, or Firm* — Amin, Turocy & Watson, LLP

(57) ABSTRACT

Techniques facilitating multiple cryogenic systems sectioned within a common vacuum space are provided. In one example, a cryostat can comprise a plurality of thermal stages and a thermal switch. The plurality of thermal stages can intervene between a 4-Kelvin (K) stage and a Cold Plate stage. The plurality of thermal stages can include a Still stage and an intermediate thermal stage that can be directly coupled mechanically to the Still stage via a support rod. The thermal switch can be coupled to the intermediate thermal stage and an adjacent thermal stage. The thermal switch can facilitate modifying a thermal profile of the cryostat by providing a switchable thermal path between the intermediate thermal stage and the adjacent thermal stage.

20 Claims, 8 Drawing Sheets

MULTIPLE CRYOGENIC SYSTEMS SECTIONED WITHIN A COMMON VACUUM SPACE

BACKGROUND

The subject disclosure relates to cryogenic environments, and more specifically, to techniques of facilitating multiple cryogenic systems sectioned within a common vacuum space.

SUMMARY

The following presents a summary to provide a basic understanding of one or more embodiments of the invention. This summary is not intended to identify key or critical elements, or delineate any scope of the particular embodiments or any scope of the claims. Its sole purpose is to present concepts in a simplified form as a prelude to the more detailed description that is presented later. In one or more embodiments described herein, systems, devices, and/or methods that facilitate multiple cryogenic systems sectioned within a common vacuum space are described.

According to an embodiment, a cryostat can comprise a plurality of thermal stages and a thermal switch. The plurality of thermal stages can intervene between a 4-Kelvin (K) stage and a Cold Plate stage. The plurality of thermal stages can include a Still stage and an intermediate thermal stage that can be directly coupled mechanically to the Still stage via a support rod. The thermal switch can be coupled to the intermediate thermal stage and an adjacent thermal stage. The thermal switch can facilitate modifying a thermal profile of the cryostat by providing a switchable thermal path between the intermediate thermal stage and the adjacent thermal stage.

According to another embodiment, a cryostat can comprise a Still stage and a thermal switch. The Still stage can be directly coupled mechanically to an intermediate thermal stage via a support rod. The Still stage and the intermediate thermal stage can be included among a plurality of thermal stages intervening between a 4-K stage and a Cold Plate stage. The thermal switch can be coupled to the intermediate thermal stage and an adjacent thermal stage. The thermal switch can facilitate modifying a thermal profile of the cryostat by providing a switchable thermal path between the intermediate thermal stage and the adjacent thermal stage.

According to another embodiment, a cryostat can comprise an enclosed thermal volume and a thermal switch. The enclosed thermal volume can be formed by an intermediate thermal stage coupled to a thermal shield. The intermediate thermal stage can be directly coupled mechanically to a Still stage via a support rod. The Still stage and the intermediate thermal stage can be included among a plurality of thermal stages intervening between a 4-K stage and a Cold Plate stage. The thermal switch can be coupled to the intermediate thermal stage and an adjacent thermal stage. The thermal switch can facilitate modifying a thermal profile of the cryostat by providing a switchable thermal path between the intermediate thermal stage and the adjacent thermal stage.

DETAILED DESCRIPTION

The following detailed description is merely illustrative and is not intended to limit embodiments and/or application or uses of embodiments. Furthermore, there is no intention to be bound by any expressed or implied information presented in the preceding Background or Summary sections, or in the Detailed Description section.

One or more embodiments are now described with reference to the drawings, wherein like referenced numerals are used to refer to like elements throughout. In the following description, for purposes of explanation, numerous specific details are set forth in order to provide a more thorough understanding of the one or more embodiments. It is evident, however, in various cases, that the one or more embodiments can be practiced without these specific details.

Figure 1:
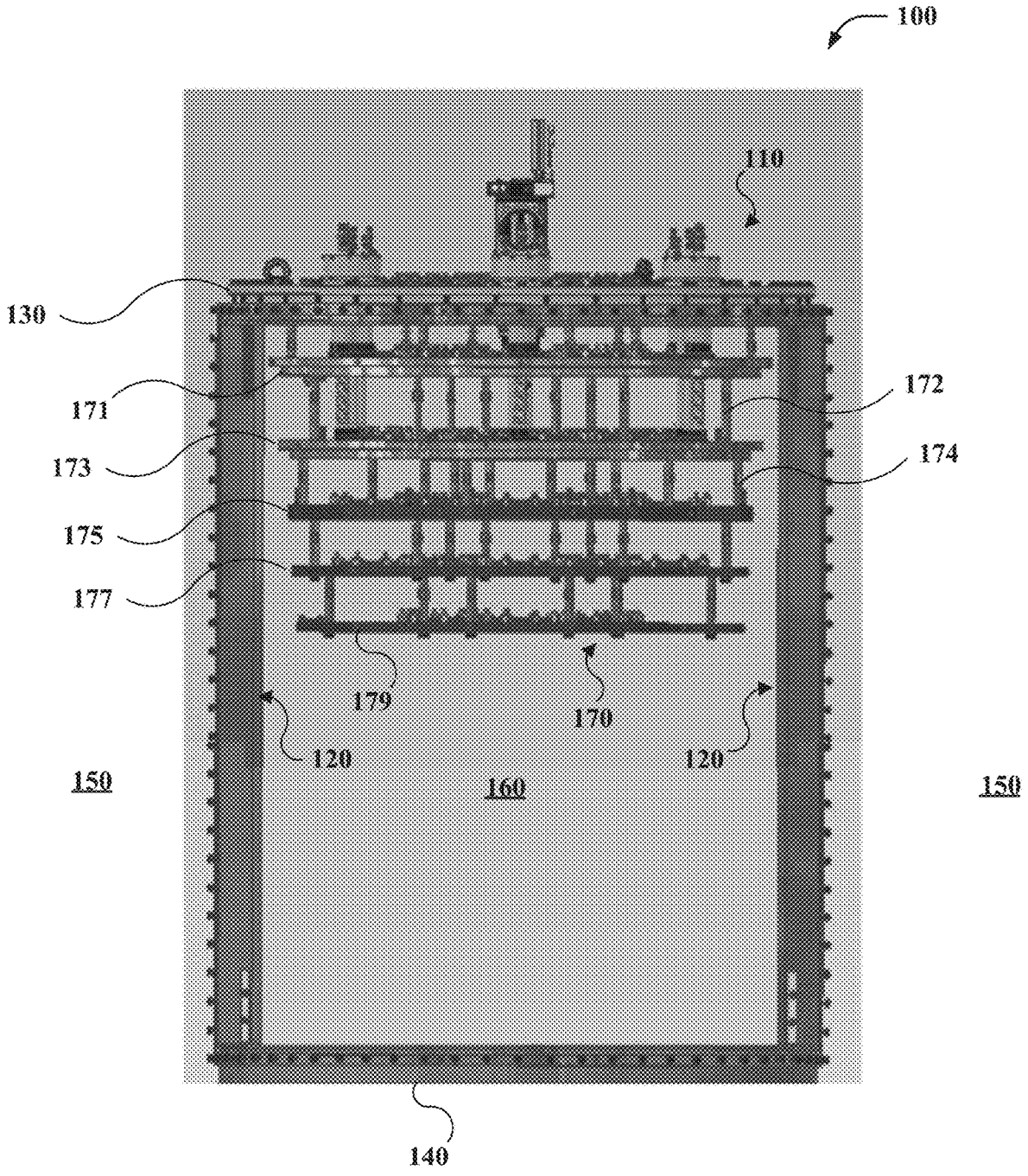
FIG. 1 illustrates an example, non-limiting cryostat, in accordance with one or more embodiments described herein.

FIG. 1 illustrates an example, non-limiting cryostat 100, in accordance with one or more embodiments described herein. As shown in FIG. 1, cryostat 100 comprises an outer vacuum chamber 110 formed by a sidewall 120 intervening between a top plate 130 and a bottom plate 140. In operation, outer vacuum chamber 110 can maintain a pressure differential between an ambient environment 150 of outer vacuum chamber 110 and an interior 160 of outer vacuum chamber 110. Cryostat 100 further comprises a plurality of thermal stages (or stages) 170 disposed within interior 160 that are each mechanically coupled to top plate 130. The plurality of stages 170 includes: stage 171, stage 173, stage 175, stage 177, and stage 179. Each stage among the plurality of stages 170 can be associated with a different temperature. For example, stage 171 can be a 50-kelvin (50-K) stage that is associated with a temperature of 50 kelvin (K), stage 173 can be a 4-kelvin (4-K) stage that is associated with a temperature of 4 K, stage 175 can be associated with a temperature of 700 millikelvin (mK), stage 177 can be associated with a temperature of 100 mK, and stage 179 can be associated with a temperature of 10 mK. Each stage among the plurality of stages 170 is spatially isolated from other stages of the plurality of stages 170 by a plurality of support rods (e.g., support rods 172 and 174). In an embodiment, stage 175 can be a Still stage, stage 177 can be a Cold Plate stage, and stage 179 can be a Mixing Chamber stage.

Figure 2:
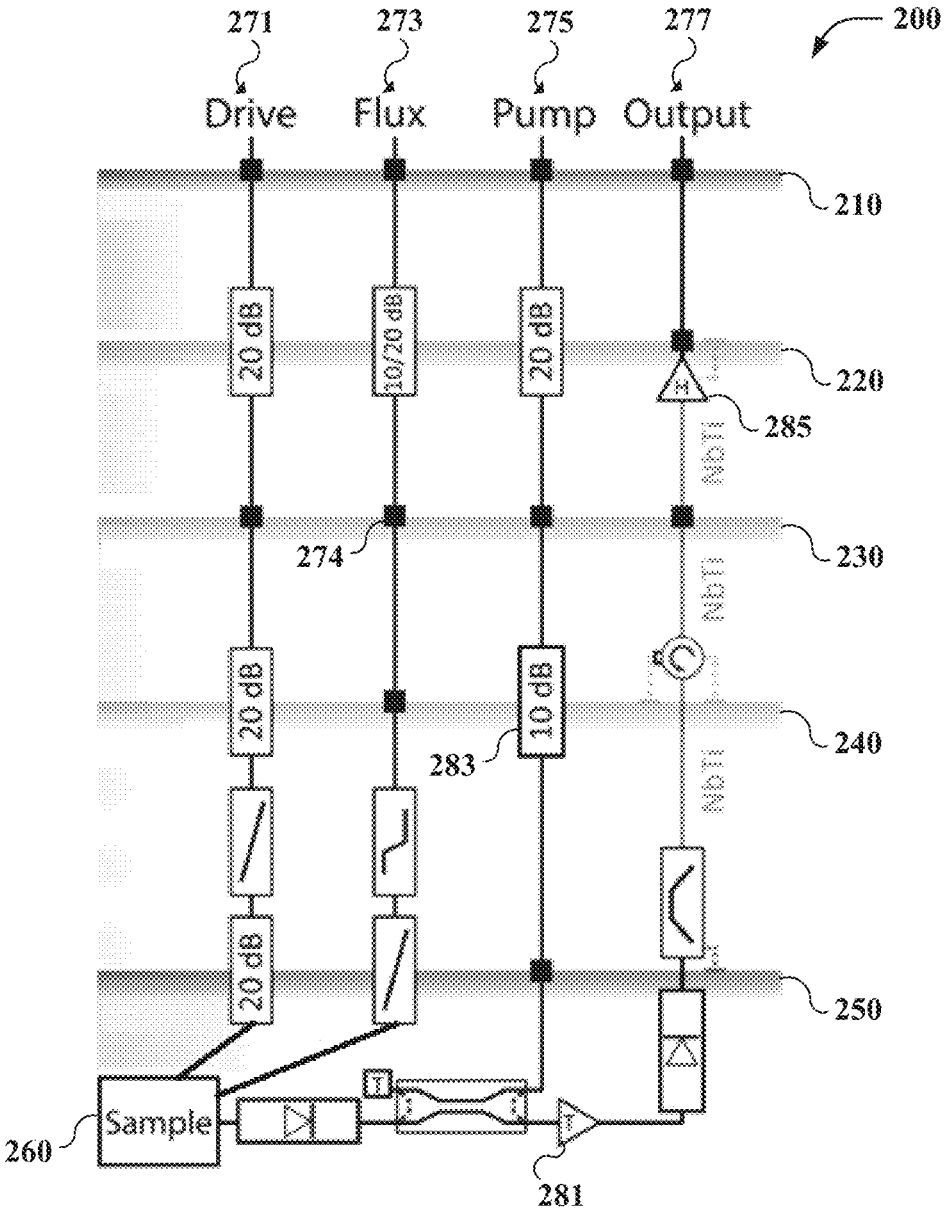
FIG. 2 illustrates a circuit schematic of an example, non-limiting cryostat, in accordance with one or more embodiments described herein.

FIG. 2 illustrates a circuit schematic of an example, non-limiting cryostat 200, in accordance with one or more embodiments described herein. A cryostat (e.g., cryostat 100 of FIG. 1) can maintain samples or devices positioned on a sample mounting surface located within the cryostat at temperatures approaching absolute zero to facilitate evaluating such samples or devices under cryogenic conditions. Cryostats generally provide such low temperatures utilizing five thermal stages that are mechanically coupled to a room temperature plate (e.g., top plate 130) of an outer vacuum chamber. The five thermal stages of a cryostat can comprise a thermal profile in which each subsequent thermal stage has a progressively lower temperature than exists at a preceding thermal stage. Evaluating samples or devices under cryogenic conditions generally involves interacting with such samples or devices using one or more devices that sit at room temperature conditions external to a cryostat. To that end, a cryostat can include input/output (I/O) lines that facilitate propagation of electrical signals between a sample positioned within the cryostat and the devices external to the cryostat.

By way of example, superconducting qubits can be positioned on a sample mounting surface 260 of cryostat 200. Coupling the superconducting qubits positioned on sample mounting surface 260 to one or more devices external to cryostat 200 are four I/O lines: a drive line 271; a flux line 273; a pump line 275; and an output (or readout) line 277. One skilled in the art will appreciate that these four I/O lines can contribute to a heat load placed on cryostat 200 in a number ways. One way that the four I/O lines can contribute to the heat load is that each I/O line can provide a thermal path along which heat can be conducted from higher temperature thermal stages to lower temperature thermal stages. For example, in FIG. 2, drive line 271 is routed from a 50-K stage 210 of cryostat 200 to a Mixing Chamber stage 250. Along that routing path through cryostat 200, drive line 271 can provide a thermal path through which heat can be conducted from higher temperature thermal stages to lower temperature thermal stages, such as from 50-K stage 210 to a 4-K stage 220.

Another way that the four I/O lines can contribute to the heat load relates to heat (e.g., Joule heating) generated due to dissipation of signals propagating along a given I/O line or via an intervening electrical component. For example, a microwave flux signal propagating along flux line 273 towards a SQUID loop associated with the superconducting qubits positioned on sample mounting surface 260 can introduce heat on a Still stage 230 of cryostat 200 via a thermal coupling 274. As another example, a microwave pump signal propagating along flux line 273 for operation of a traveling wave parametric amplifier (TWPA) 281 can introduce heat on a Cold stage 240 via an attenuator 283 coupled to flux line 273 and Cold stage 240.

Another way that the four I/O lines can contribute to the heat load involves a radiative load that higher temperature thermal stages represent to lower temperature thermal stages. For example, direct current (DC) signals biasing a high electron mobility transistor (HEMT) amplifier 285 to facilitate measurement of the superconducting qubits positioned on sample mounting surface 260 via output line 277 can introduce heat on the 4-K stage 220. Such heat introduced on the 4-K stage 220 can expose lower temperature thermal stages (e.g., Still stage 230) to a radiative load that the 4-K stage 220 represents to the lower temperature thermal stages as 4 K blackbody radiation.

As discussed above, cryostats can maintain samples or devices positioned on a sample mounting surface located within the cryostat at temperatures approaching absolute zero to facilitate evaluating such samples or devices under cryogenic conditions. The five thermal stages of a cryostat generally used to provide such cryogenic conditions can comprise a thermal profile in which each subsequent thermal stage has a progressively lower temperature than exists at a preceding thermal stage. That thermal profile can exist within a common vacuum space defined by an outer vacuum chamber of the cryostat that encloses the five thermal stages.

In some instances, temperatures approaching absolute zero can be advantageous in evaluating samples or devices under cryogenic conditions. For example, temperatures approaching absolute zero can be advantageous in evaluating incoherent noise in superconducting circuits, exotic phase transitions in confined superfluid helium-3, and topological effects of localization and disorder in highly correlated systems. In other instances, higher temperatures can be sufficient to evaluate samples or devices under cryogenic conditions. For example, temperatures of about 4 K can be sufficient to evaluate HEMT devices or some niobium (Nb) resonators under cryogenic conditions. As another example, temperatures of about 1 K can be sufficient to evaluate some Josephson Junction (JJ) devices (e.g., JJ field-effect transistors) or some NB resonators under cryogenic conditions. As another example, temperatures of about 300 mK can be sufficient to evaluate qubit devices, microwave components, or some JJ devices. Therefore, multiple cryogenic systems sectioned within a common vacuum space of a cryostat can facilitate improved efficiency by flexibly modifying a thermal profile of the cryostat to accommodate varying evaluation conditions. Embodiments described herein facilitate multiple cryogenic systems sectioned within a common vacuum space by providing switchable thermal paths between intermediate thermal stages providing additional cooling capacity to a cryostat and adjacent thermal stages.

Figure 3:
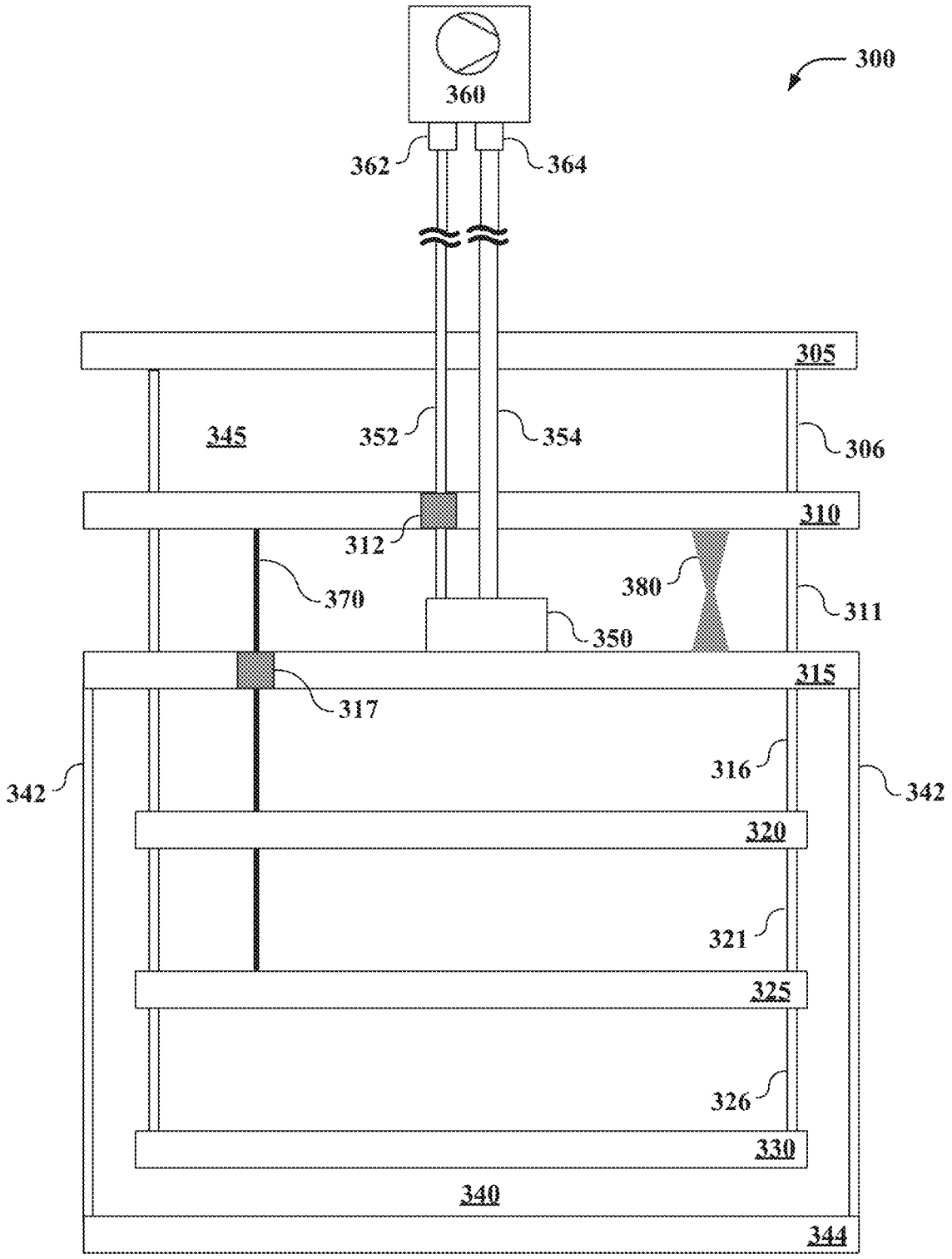
FIG. 3 illustrates an example, non-limiting cryostat with a switchable thermal path that facilitates multiple cryogenic systems sectioned within a common vacuum space, in accordance with one or more embodiments described herein.

FIG. 3 illustrates an example, non-limiting cryostat 300 with a switchable thermal path that facilitates multiple cryogenic systems sectioned within a common vacuum space, in accordance with one or more embodiments described herein. As shown by FIG. 3, cryostat 300 comprises a 50-K stage 305 that can be coupled to a room temperature plate (e.g., top plate 130 of FIG. 1) of an outer vacuum chamber (not shown). The outer vacuum chamber can define a common vacuum space (e.g., interior 160) enclosing the various thermal stages of cryostat 300 at a common pressure.

Cryostat 300 further comprises a plurality of thermal stages intervening between a 4-K stage 310 and a Cold Plate stage 325. Those plurality of thermal stages include a Still stage 320 and an intermediate thermal stage 315. Intermediate thermal stage 315 is directly coupled mechanically to 4-K stage 310 via support rod 311 and Still stage 320 via support rod 316. Intermediate thermal stage 315 is indirectly coupled mechanically to 50-K stage 305 via support rod 306, Cold Plate stage 325 via support rod 321, and Mixing Chamber stage 330 via support rod 326.

FIG. 3 also shows that cryostat 300 further comprises an enclosed thermal volume 340 that can be formed by a thermal shield 342 coupled to intermediate thermal stage 315. Enclosed thermal volume 340 can be thermally isolated from a volume 345 of cryostat 300 that is external to enclosed thermal volume 340. In FIG. 3, thermal shield 342 is illustrated as intervening between intermediate thermal stage 315 and a thermal plate 344 to form enclosed thermal volume 340. However, in other embodiments, thermal shield 342 and thermal plate 344 can be implemented as a unitary element such that coupling the unitary element to intermediate thermal stage 315 can form enclosed thermal volume 340.

Intermediate thermal stage 315 can comprise a feedthrough element 317 that intervenes in a wiring structure 370 that facilitates propagation of electrical signals between 4-K stage 310 and Cold Plate stage 325. Wiring structure 370 can comprise an I/O line coupling a sample positioned within cryostat 300 and one or more devices external to cryostat 300. For example, wiring structure 370 can comprise an I/O line such as drive line 271, flux line 273, pump line 275, and/or output (or readout) line 277 of FIG. 2. In an embodiment, intermediate thermal stage 315 can comprise copper, gold, silver, brass, platinum, or a combination thereof.

Intermediate thermal stage 315 can provide additional cooling capacity for cryostat 300 via a sealed pot 350 coupled to intermediate thermal stage 315. To that end, sealed pot 350 facilitates evaporative cooling of a helium medium-helium-4. A condenser line 352 can couple an outlet port 362 of a pump 360 to sealed pot 350 via 4-K stage 310. In an embodiment, pump 360 can be a vacuum pump for circulating a helium medium through sealed pot 350. In an embodiment, pump 360 can be located external to cryostat 300. In an embodiment, pump 360 can be located within cryostat 300. In this embodiment, pump 360 can be implemented as a sorb pump. Condenser line 352 can provide a return path for the helium medium to sealed pot 350. A pumping line 354 can couple an inlet port 364 of pump 360 to sealed pot 350 via 4-K stage 310. 4-K stage 310 can provide passage for condenser line 352 and/or pumping line 354 via a feedthrough element, such as feedthrough element 312.

As shown by FIG. 3, cryostat 300 further comprises a thermal switch 380 coupled to intermediate thermal stage 315 and an adjacent thermal stage. In the example of FIG. 3, that adjacent thermal stage is 4-K stage 310. An example, non-limiting thermal switch that is suitable for implementing thermal switch 380 will be discussed in greater detail below with respect to FIGS. 6-7. Thermal switch 380 can facilitate modifying a thermal profile of cryostat 300 by providing a switchable thermal path between intermediate thermal stage 315 and 4-K stage 310. To that end, a transfer medium of thermal switch 380 can provide a thermal path that thermally couples (or shorts) intermediate thermal stage 315 to 4-K stage 310 when thermal switch 380 is in a coupling state. When thermal switch 380 transitions from the coupling state to a decoupling state, the thermal path provided by the transfer medium of thermal switch 380 can be removed, thereby thermally decoupling intermediate thermal stage 315 from 4-K stage 310.

In an embodiment, the transfer medium can comprise a helium medium. In an embodiment, the transfer medium can comprise a superconducting material (e.g., aluminum). In this embodiment, thermal switch 380 can be transitioned into the decoupling state by transitioning the transfer medium from a non-superconducting state to a superconducting state. In an embodiment, the transfer medium can be transitioned from the non-superconducting state to the superconducting state by decreasing a temperature of the transfer medium below a critical temperature of the superconducting material. In an embodiment, the superconducting material can be positioned within a magnetic field. In an embodiment, the transfer medium can be transitioned from the superconducting state to the non-superconducting state by increasing a strength of a magnetic field above a critical magnetic field of the superconducting material.

In operation, helium-4 can flow from outlet port 362 towards sealed pot 350 in a gaseous state. Feedthrough element 312 can thermally anchor condenser line 352 to 4-K stage 310. As the helium-4 flows past feedthrough element 312, the helium-4 can transition from the gaseous state to a liquid state. Helium-4 in the liquid state can collect in sealed pot 350. When thermal switch 380 is in the decoupling state, inlet port 364 of pump 360 can be operated to reduce a pressure above the liquified helium-4 collected in sealed pot 350. Helium-4 in the gaseous state can form above the liquified helium-4 collected in sealed pot 350 through evaporation and flow to inlet port 364 of pump 360 via pumping line 354. Heat carried by the helium-4 in the gaseous state flowing through pumping line 354 can reduce a temperature of the liquified helium-4 remaining in sealed pot 350. Such evaporative cooling of the liquified helium-4 in sealed pot 350 can reduce a temperature of intermediate thermal stage 315 such that intermediate thermal stage 315 can operate at a temperature of about 1 K.

Operating intermediate thermal stage 315 at a temperature of about 1 K can facilitate sectioning cryostat 300 into multiple cryogenic systems (e.g., enclosed thermal volume 340 and volume 345) operating at different temperatures within a common vacuum space. For example, cryostat 300 can further comprise additional thermal switches (not shown), such as a thermal switch intervening between intermediate thermal stage 315 and Still stage 320; a thermal switch intervening between Still stage 320 and Cold Plate stage 325; and a thermal switch intervening between Cold Plate stage 325 and Mixing Chamber stage 330. In this example, each intervening thermal switch can be transitioned to a coupling state such that Still stage 320, Cold Plate stage 325, and Mixing Chamber stage 330 can each be thermally equalized with intermediate thermal stage 315 to operate at a temperature of about 1 K.

When thermal switch 380 is in the coupling state, inlet port 364 of pump 360 can be operated to maintain a pressure above the liquified helium-4 collected in sealed pot 350 at the common pressure of the common vacuum space. Maintaining the pressure above the liquified helium-4 collected in sealed pot 350 at the common pressure can impede evaporative cooling of the liquified helium-4 in sealed pot 350. Absent such evaporative cooling, intermediate thermal stage 315 can be thermally equalized with 4-K stage 310 via the thermal path provided by thermal switch 380 such that intermediate thermal stage 315 can operate at a temperature of about 4 K. In an embodiment, sealed pot 350 can be vacuum sealed or cryogenically sealed. In an embodiment, sealed pot 350 can comprise sintered material that facilitates thermal budget optimization. The sintered material can comprise silver, gold, copper, platinum, and the like.

Figure 4:
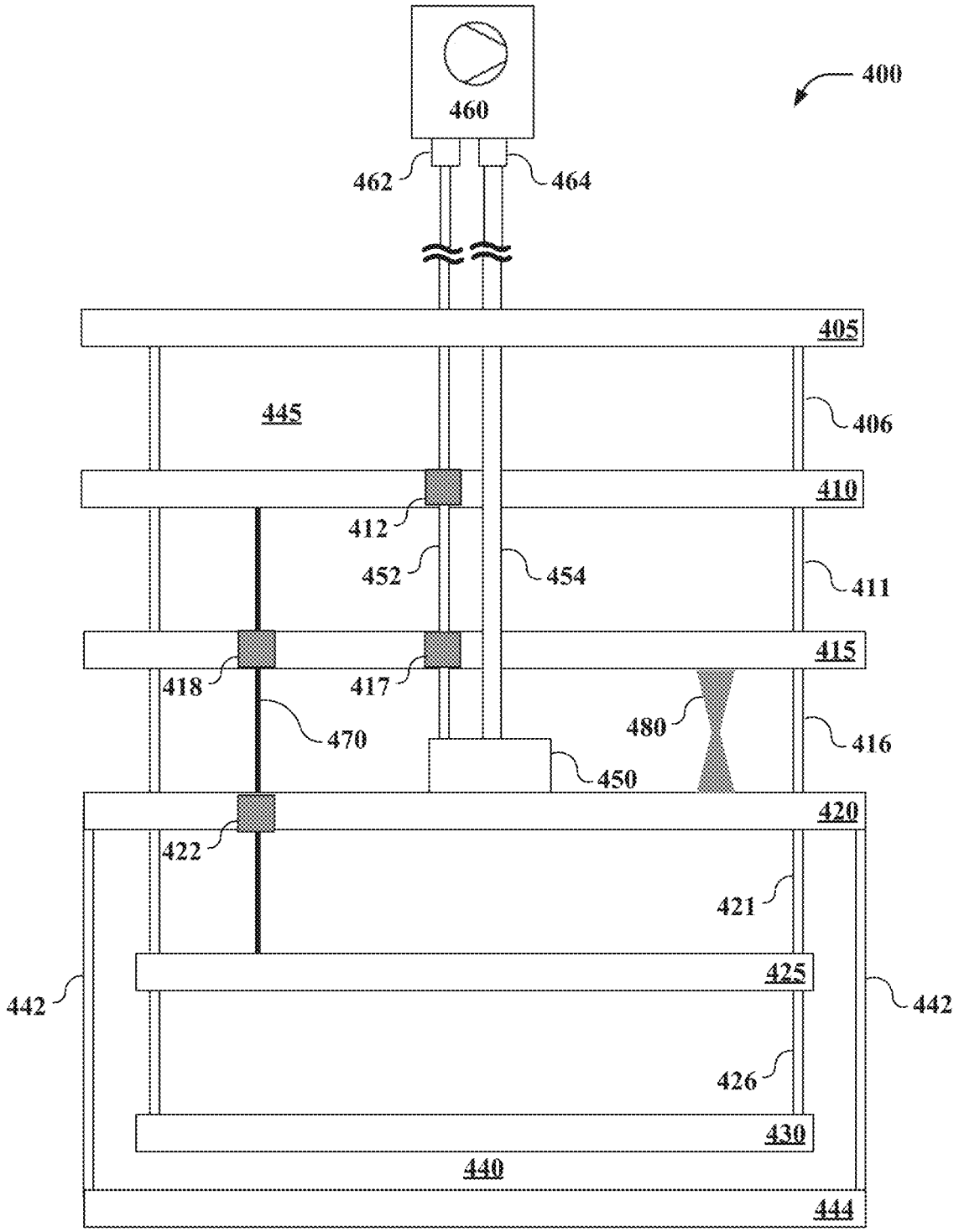
FIG. 4 illustrates another example, non-limiting cryostat with a switchable thermal path that facilitates multiple cryogenic systems sectioned within a common vacuum space, in accordance with one or more embodiments described herein.

FIG. 4 illustrates another example, non-limiting cryostat 400 with a switchable thermal path that facilitates multiple cryogenic systems sectioned within a common vacuum space, in accordance with one or more embodiments described herein. As shown by FIG. 4, cryostat 400 comprises a 50-K stage 405 that can be coupled to a room temperature plate (e.g., top plate 130 of FIG. 1) of an outer vacuum chamber (not shown). The outer vacuum chamber can define a common vacuum space (e.g., interior 160) enclosing the various thermal stages of cryostat 400 at a common pressure.

Cryostat 400 further comprises a plurality of thermal stages intervening between a 4-K stage 410 and a Cold Plate stage 425. Those plurality of thermal stages include a Still stage 415 and an intermediate thermal stage 420. Intermediate thermal stage 420 is directly coupled mechanically to Still stage 415 via support rod 416 and Cold Plate stage 425 via support rod 421. Intermediate thermal stage 420 is indirectly coupled mechanically to 50-K stage 405 via support rod 406, 4-K stage 410 via support rod 411, and Mixing Chamber stage 430 via support rod 426.

FIG. 4 also shows that cryostat 400 further comprises an enclosed thermal volume 440 that can be formed by a thermal shield 442 coupled to intermediate thermal stage 420. Enclosed thermal volume 440 can be thermally isolated from a volume 445 of cryostat 400 that is external to enclosed thermal volume 340. In FIG. 4, thermal shield 442 is illustrated as intervening between intermediate thermal stage 420 and a thermal plate 444 to form enclosed thermal volume 440. However, in other embodiments, thermal shield 442 and thermal plate 444 can be implemented as a unitary element such that coupling the unitary element to intermediate thermal stage 420 can form enclosed thermal volume 440.

Intermediate thermal stage 420 can comprise a feedthrough element 422 that intervenes in a wiring structure 470 that facilitates propagation of electrical signals between 4-K stage 410 and Cold Plate stage 425. Still stage 415 can also comprise a feedthrough element 418 that intervenes in wiring structure 470. Wiring structure 470 can comprise an 110 line coupling a sample positioned within cryostat 400 and one or more devices external to cryostat 400. For example, wiring structure 470 can comprise an 110 line such as drive line 271, flux line 273, pump line 275, and/or output (or readout) line 277 of FIG. 2. In an embodiment, intermediate thermal stage 420 can comprise copper, gold, silver, brass, platinum, or a combination thereof.

Intermediate thermal stage 420 can provide additional cooling capacity for cryostat 400 via a sealed pot 450 coupled to intermediate thermal stage 420. To that end, sealed pot 450 facilitates evaporative cooling of a helium medium-helium-3. A condenser line 452 can couple an outlet port 462 of a pump 460 to sealed pot 450 via 4-K stage 410. In an embodiment, pump 460 can be a vacuum pump for circulating a helium medium through sealed pot 450. In an embodiment, pump 460 can be located external to cryostat 400. In an embodiment, pump 460 can be located within cryostat 400. In this embodiment, pump 460 can be implemented as a sorb pump. Condenser line 452 can provide a return path for the helium medium to sealed pot 450. A pumping line 454 can couple an inlet port 464 of pump 460 to sealed pot 450 via 4-K stage 410. 4-K stage 410 can provide passage for condenser line 452 and/or pumping line 454 via a feedthrough element, such as feedthrough element 412. Still stage 415 can provide passage for condenser line 452 and/or pumping line 454 via a feedthrough element, such as feedthrough element 422.

As shown by FIG. 4, cryostat 400 further comprises a thermal switch 480 coupled to intermediate thermal stage 420 and an adjacent thermal stage. In the example of FIG. 4, that adjacent thermal stage is Still stage 415. An example, non-limiting thermal switch that is suitable for implementing thermal switch 480 will be discussed in greater detail below with respect to FIGS. 6-7. Thermal switch 480 can facilitate modifying a thermal profile of cryostat 400 by providing a switchable thermal path between intermediate thermal stage 420 and Still stage 415. To that end, a transfer medium of thermal switch 480 can provide a thermal path that thermally couples (or shorts) intermediate thermal stage 420 to Still stage 415 when thermal switch 480 is in a coupling state. When thermal switch 480 transitions from the coupling state to a decoupling state, the thermal path provided by the transfer medium of thermal switch 480 can be removed, thereby thermally decoupling intermediate thermal stage 420 from Still stage 415.

In an embodiment, the transfer medium can comprise a helium medium. In an embodiment, the transfer medium can comprise a superconducting material (e.g., aluminum). In this embodiment, thermal switch 480 can be transitioned into the decoupling state by transitioning the transfer medium from a non-superconducting state to a superconducting state. In an embodiment, the transfer medium can be transitioned from the non-superconducting state to the superconducting state by decreasing a temperature of the transfer medium below a critical temperature of the superconducting material. In an embodiment, the superconducting material can be positioned within a magnetic field. In an embodiment, the transfer medium can be transitioned from the superconducting state to the non-superconducting state by increasing a strength of a magnetic field above a critical magnetic field of the superconducting material.

In operation, helium-3 can flow from outlet port 462 towards sealed pot 450 in a gaseous state. Feedthrough elements 412 and/or 417 can thermally anchor condenser line 452 to 4-K stage 410 and/or Still stage 415, respectively. As the helium-3 flows past feedthrough elements 412 and/or 417, the helium-3 can transition from the gaseous state to a liquid state. Helium-3 in the liquid state can collect in sealed pot 450. When thermal switch 480 is in the decoupling state, inlet port 464 of pump 460 can be operated to reduce a pressure above the liquified helium-3 collected in sealed pot 450. Helium-3 in the gaseous state can form above the liquified helium-3 collected in sealed pot 450 through evaporation and flow to inlet port 464 of pump 460 via pumping line 454. Heat carried by the helium-3 in the gaseous state flowing through pumping line 454 can reduce a temperature of the liquified helium-3 remaining in sealed pot 450. Such evaporative cooling of the liquified helium-3 in sealed pot 470 can reduce a temperature of intermediate thermal stage 420 such that intermediate thermal stage 420 can operate at a temperature of about 300 mK.

Operating intermediate thermal stage 420 at a temperature of about 300 mK can facilitate sectioning cryostat 400 into multiple cryogenic systems (e.g., enclosed thermal volume 440 and volume 445) operating at different temperatures within a common vacuum space. For example, cryostat 400 can further comprise additional thermal switches (not shown), such as a thermal switch intervening between intermediate thermal stage 420 and Cold Plate stage 425; and a thermal switch intervening between Cold Plate stage 425 and Mixing Chamber stage 430. In this example, each intervening thermal switch can be transitioned to a coupling state such that Cold Plate stage 425 and Mixing Chamber stage 430 can each be thermally equalized with intermediate thermal stage 420 to operate at a temperature of about 300 mK.

When thermal switch 480 is in the coupling state, inlet port 464 of pump 460 can be operated to maintain a pressure above the liquified helium-3 collected in sealed pot 450 at the common pressure of the common vacuum space. Maintaining the pressure above the liquified helium-3 collected in sealed pot 450 at the common pressure can impede evaporative cooling of the liquified helium-3 in sealed pot 450. Absent such evaporative cooling, intermediate thermal stage 420 can be thermally equalized with Still stage 415 via the thermal path provided by thermal switch 480 such that intermediate thermal stage 420 can operate at a temperature of about 700 mK. In an embodiment, sealed pot 450 can be vacuum sealed or cryogenically sealed. In an embodiment, sealed pot 450 can comprise sintered material that facilitates thermal budget optimization. The sintered material can comprise silver, gold, copper, platinum, and the like.

Figure 5:
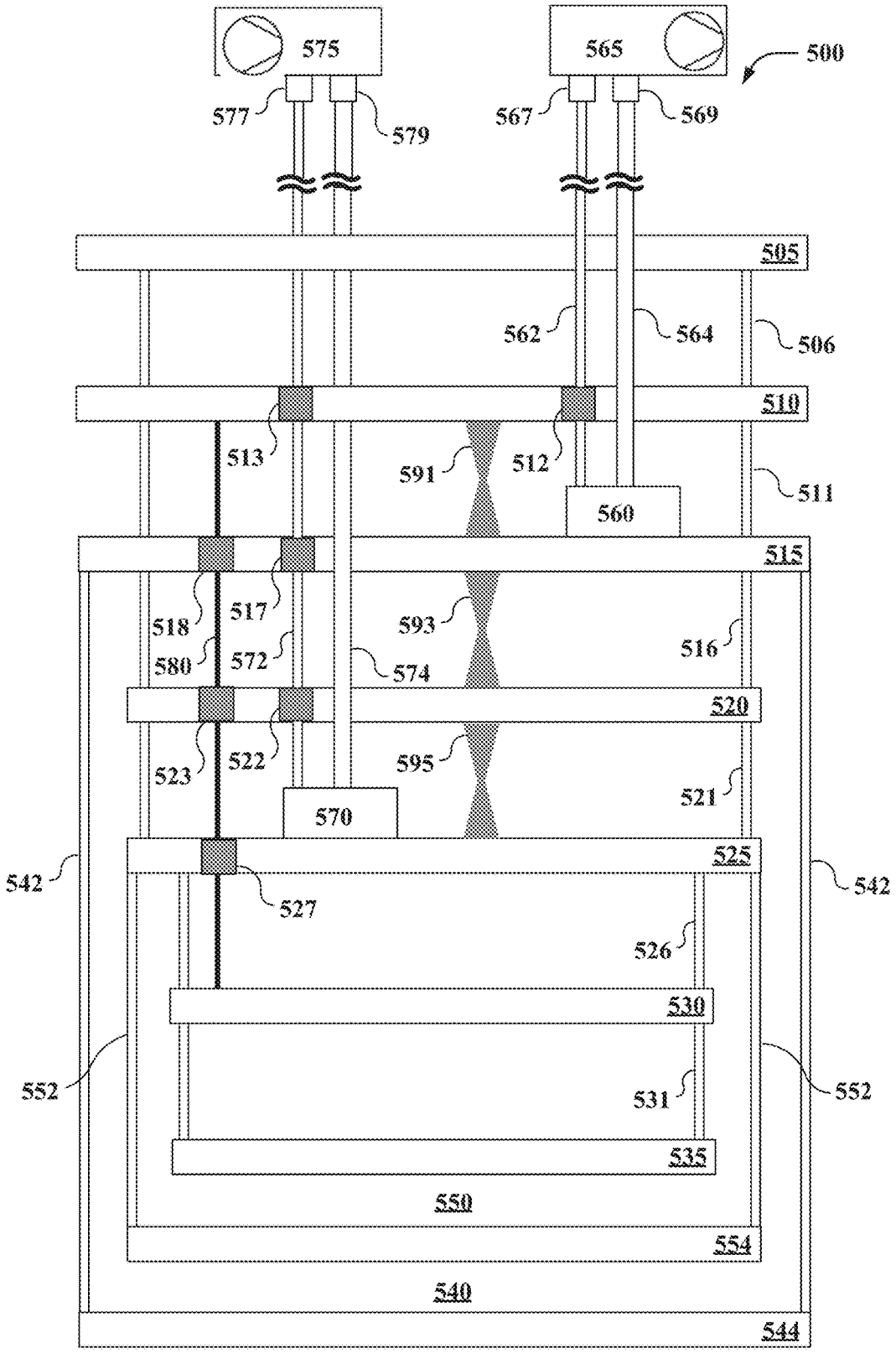
FIG. 5 illustrates an example, non-limiting cryostat with multiple switchable thermal paths that facilitate multiple cryogenic systems sectioned within a common vacuum space, in accordance with one or more embodiments described herein.

FIG. 5 illustrates an example, non-limiting cryostat 500 with multiple switchable thermal paths that facilitate multiple cryogenic systems sectioned within a common vacuum space, in accordance with one or more embodiments described herein. As shown by FIG. 5, cryostat 500 comprises a 50-K stage 505 that can be coupled to a room temperature plate (e.g., top plate 130 of FIG. 1) of an outer vacuum chamber (not shown). The outer vacuum chamber can define a common vacuum space (e.g., interior 160) enclosing the various thermal stages of cryostat 500 at a common pressure. Cryostat 500 further comprises a plurality of thermal stages intervening between a 4-K stage 510 and a Cold Plate stage 530. Those plurality of thermal stages include a Still stage 520 and multiple intermediate thermal stages (e.g., intermediate thermal stage 515 and intermediate thermal stage 525).

FIG. 5 also shows that cryostat 500 further comprises an enclosed thermal volume 540 and an enclosed thermal volume 550 nested within enclosed thermal volume 540. Enclosed thermal volume 540 can be thermally isolated from enclosed thermal volume 550 and a volume 545 of cryostat 500 that is external to enclosed thermal volume 540. Enclosed thermal volume 540 can be formed by a thermal shield 542 coupled to intermediate thermal stage 515. In FIG. 5, thermal shield 542 is illustrated as intervening between intermediate thermal stage 515 and a thermal plate 544 to form enclosed thermal volume 540. However, in other embodiments, thermal shield 542 and thermal plate 544 can be implemented as a unitary element such that coupling the unitary element to intermediate thermal stage 515 can form enclosed thermal volume 540. Enclosed thermal volume 550 can be formed by a thermal shield 552 coupled to intermediate thermal stage 525. In FIG. 5, thermal shield 552 is illustrated as intervening between intermediate thermal stage 525 and a thermal plate 554 to form enclosed thermal volume 550. However, in other embodiments, thermal shield 552 and thermal plate 554 can be implemented as a unitary element such that coupling the unitary element to intermediate thermal stage 525 can form enclosed thermal volume 550.

Intermediate thermal stage 515 is directly coupled mechanically to 4-K stage 510 via support rod 511 and Still stage 520 via support rod 516. Intermediate thermal stage 515 is indirectly coupled mechanically to 50-K stage 505 via support rod 506, intermediate thermal stage 525 via support rod 521, Cold Plate stage 530 via support rod 526, and Mixing Chamber stage 535 via support rod 531. Intermediate thermal stage 525 is directly coupled mechanically to Still stage 520 via support rod 521 and Cold Plate stage 530 via support rod 526. Intermediate thermal stage 525 is indirectly coupled mechanically to 50-K stage 505 via support rod 506, 4-K stage 510 via support rod 511, intermediate thermal stage 515 via support rod 516, and Mixing Chamber stage 535 via support rod 531. Intermediate thermal stages 515 and 525 are directly coupled mechanically to opposing sides of Still stage 520 via support rods 516 and 521, respectively.

Intermediate thermal stages 515 and 525 can comprise feedthrough elements 518 and 527, respectively, that intervene in a wiring structure 580 that facilitates propagation of electrical signals between 4-K stage 510 and Cold Plate stage 530. Still stage 520 can also comprise a feedthrough element 523 that intervenes in wiring structure 580. Wiring structure 580 can comprise an I/O line coupling a sample positioned within cryostat 500 and one or more devices external to cryostat 500. For example, wiring structure 580 can comprise an I/O line such as drive line 271, flux line 273, pump line 275, and/or output (or readout) line 277 of FIG. 2. In an embodiment, intermediate thermal stages 515 and/or 525 can comprise copper, gold, silver, brass, platinum, or a combination thereof.

Intermediate thermal stage 515 can provide additional cooling capacity for cryostat 500 via a sealed pot 560 coupled to intermediate thermal stage 515. To that end, sealed pot 560 facilitates evaporative cooling of a helium medium-helium-4. A condenser line 562 can couple an outlet port 567 of a pump 565 to sealed pot 560 via 4-K stage 510. Condenser line 562 can provide a return path for that helium medium to sealed pot 560. A pumping line 564 can couple an inlet port 569 of pump 565 to sealed pot 560 via 4-K stage 510. 4-K stage 510 can provide passage for condenser line 562 and/or pumping line 564 via a feedthrough element, such as feedthrough element 512.

Intermediate thermal stage 525 can provide additional cooling capacity for cryostat 500 via a sealed pot 570 coupled to intermediate thermal stage 525. To that end, sealed pot 570 facilitates evaporative cooling of a helium medium-helium-3. A condenser line 572 can couple an outlet port 577 of a pump 575 to sealed pot 570 via 4-K stage 510. In an embodiment, pumps 565 and/or 575 can be a vacuum pump for circulating a corresponding helium medium through sealed pots 560 and/or 570, respectively. In an embodiment, pumps 565 and/or 575 can be located external to cryostat 500. In an embodiment, pumps 565 and/or 575 can be located within cryostat 500. In this embodiment, pumps 565 and/or 575 can be implemented as a sorb pump. Condenser line 572 can provide a return path for that helium medium to sealed pot 570. A pumping line 574 can couple an inlet port 579 of pump 575 to sealed pot 570 via 4-K stage 510. 4-K stage 510 can provide passage for condenser line 572 and/or pumping line 574 via a feedthrough element, such as feedthrough element 513. Intermediate thermal stage 515 can provide passage for condenser line 572 and/or pumping line 574 via a feedthrough element, such as feedthrough element 517. Still stage 520 can provide passage for condenser line 572 and/or pumping line 574 via a feedthrough element, such as feedthrough element 522.

As shown by FIG. 5, cryostat 500 further comprises multiple thermal switches coupled to various thermal stages of cryostat 500. The multiple thermal switches include: a thermal switch 591 coupled to 4-K stage 510 and intermediate thermal stage 515; a thermal switch 593 coupled to intermediate thermal stage 515 and Still stage 520; and a thermal switch 595 coupled to Still stage 520 and intermediate thermal stage 525. An example, non-limiting thermal switch that is suitable for implementing thermal switches 591, 593, and/or 595 will be discussed in greater detail below with respect to FIGS. 6-7. Thermal switches 591, 593, and/or 595 can each facilitate modifying a thermal profile of cryostat 500 by providing a switchable thermal path between the various thermal stages of cryostat 500.

To that end, each thermal switch can comprise a transfer medium that can provide a thermal path that thermally couples (or shorts) respective thermal stages when that thermal switch is in a coupling state. For example, thermal switch 591 can comprise a transfer medium that can provide a thermal path that thermally couples intermediate thermal stage 515 to 4-K stage 510 when thermal switch 591 is in a coupling state. When a given thermal switch transitions from the coupling state to a decoupling state, the thermal path provided by the transfer medium of that thermal switch can be removed, thereby thermally decoupling the respective thermal stages. Continuing with the example above, the thermal path provided by the transfer medium of thermal switch 591 can be removed when thermal switch 591 transitions to the decoupling state, thereby thermally decoupling intermediate thermal stage 515 from 4-K stage 510.

In an embodiment, the transfer medium can comprise a helium medium. In an embodiment, the transfer medium can comprise a superconducting material (e.g., aluminum). In this embodiment, thermal switch 830 can be transitioned into the decoupling state by transitioning the transfer medium from a non-superconducting state to a superconducting state. In an embodiment, the transfer medium can be transitioned from the non-superconducting state to the superconducting state by decreasing a temperature of the transfer medium below a critical temperature of the superconducting material. In an embodiment, the superconducting material can be positioned within a magnetic field. In an embodiment, the transfer medium can be transitioned from the superconducting state to the non-superconducting state by increasing a strength of a magnetic field above a critical magnetic field of the superconducting material.

In operation, helium-4 can flow from outlet port 567 towards sealed pot 560 in a gaseous state. Feedthrough element 512 can thermally anchor condenser line 562 to 4-K stage 510. As the helium-4 flows past feedthrough element 512, the helium-4 can transition from the gaseous state to a liquid state. Helium-4 in the liquid state can collect in sealed pot 560. When thermal switch 591 is in the decoupling state, inlet port 567 of pump 565 can be operated to reduce a pressure above the liquified helium-4 collected in sealed pot 560. Helium-4 in the gaseous state can form above the liquified helium-4 collected in sealed pot 560 through evaporation and flow to inlet port 569 of pump 560 via pumping line 564. Heat carried by the helium-4 in the gaseous state flowing through pumping line 564 can reduce a temperature of the liquified helium-4 remaining in sealed pot 560. Such evaporative cooling of the liquified helium-4 in sealed pot 540 can reduce a temperature of intermediate thermal stage 515 such that intermediate thermal stage 515 can operate at a temperature of about 1 K.

Operating intermediate thermal stage 515 at a temperature of about 1 K can facilitate sectioning cryostat 500 into multiple cryogenic systems (e.g., enclosed thermal volume 540 and volume 545) operating at different temperatures within a common vacuum space. For example, cryostat 500 can further comprise additional thermal switches (not shown), such as a thermal switch intervening between intermediate thermal stage 525 and Cold Plate stage 530; and a thermal switch intervening between Cold Plate stage 530 and Mixing Chamber stage 535. In this example, each thermal switch intervening between intermedial thermal stage 515 and Mixing Chamber stage 535 (i.e., thermal switches 593 and 595 along with the additional thermal switches intervening between intermediate thermal stage 525, Cold Plate stage 530, and Mixing Chamber stage 535) can be transitioned to a coupling state. By transitioning those intervening thermal switches to the coupling state, Mixing Chamber stage 535 and each thermal stage intervening between intermediate thermal stage 515 and Mixing Chamber stage 535 can be thermally equalized with intermediate thermal stage 515 to operate at a temperature of about 1 K.

When thermal switch 591 is in the coupling state, inlet port 567 of pump 565 can be operated to maintain a pressure above the liquified helium-4 collected in sealed pot 560 at the common pressure of the common vacuum space. Maintaining the pressure above the liquified helium-4 collected in sealed pot 560 at the common pressure can impede evaporative cooling of the liquified helium-4 in sealed pot 560. Absent such evaporative cooling, intermediate thermal stage 515 can be thermally equalized with 4-K stage 510 via the thermal path provided by thermal switch 591 such that intermediate thermal stage 515 can operate at a temperature of about 4 K.

In operation, helium-4 can flow from outlet port 567 towards sealed pot 560 in a gaseous state. Feedthrough element 512 can thermally anchor condenser line 562 to 4-K stage 510. As the helium-4 flows past feedthrough element 512, the helium-4 can transition from the gaseous state to a liquid state. Helium-4 in the liquid state can collect in sealed pot 560. When thermal switch 591 is in the decoupling state, inlet port 567 of pump 565 can be operated to reduce a pressure above the liquified helium-4 collected in sealed pot 560. Helium-4 in the gaseous state can form above the liquified helium-4 collected in sealed pot 560 through evaporation and flow to inlet port 569 of pump 560 via pumping line 564. Heat carried by the helium-4 in the gaseous state flowing through pumping line 564 can reduce a temperature of the liquified helium-4 remaining in sealed pot 560. Such evaporative cooling of the liquified helium-4 in sealed pot 540 can reduce a temperature of intermediate thermal stage 515 such that intermediate thermal stage 515 can operate at a temperature of about 1 K.

Operating intermediate thermal stage 515 at a temperature of about 1 K can facilitate sectioning cryostat 500 into multiple cryogenic systems (e.g., enclosed thermal volume 540 and volume 545) operating at different temperatures within a common vacuum space. For example, cryostat 500 can further comprise additional thermal switches (not shown), such as a thermal switch intervening between intermediate thermal stage 525 and Cold Plate stage 530; and a thermal switch intervening between Cold Plate stage 530 and Mixing Chamber stage 535. In this example, each thermal switch intervening between intermedial thermal stage 515 and Mixing Chamber stage 535 (i.e., thermal switches 593 and 595 along with the additional thermal switches intervening between intermediate thermal stage 525, Cold Plate stage 530, and Mixing Chamber stage 535) can be transitioned to a coupling state. By transitioning those intervening thermal switches to the coupling state, Mixing Chamber stage 535 and each thermal stage intervening between intermediate thermal stage 515 and Mixing Chamber stage 535 can be thermally equalized with intermediate thermal stage 515 to operate at a temperature of about 1 K.

When thermal switch 591 is in the coupling state, inlet port 567 of pump 565 can be operated to maintain a pressure above the liquified helium-4 collected in sealed pot 560 at the common pressure of the common vacuum space. Maintaining the pressure above the liquified helium-4 collected in sealed pot 560 at the common pressure can impede evaporative cooling of the liquified helium-4 in sealed pot 560. Absent such evaporative cooling, intermediate thermal stage 515 can be thermally equalized with 4-K stage 510 via the thermal path provided by thermal switch 591 such that intermediate thermal stage 515 can operate at a temperature of about 4 K.

In operation, helium-3 can flow from outlet port 577 towards sealed pot 570 in a gaseous state. Feedthrough elements 513, 517, and/or 522 can thermally anchor condenser line 572 to 4-K stage 510, intermediate thermal stage 515, and/or Still stage 520, respectively. As the helium-3 flows past feedthrough elements 513, 517, and/or 522, the helium-3 can transition from the gaseous state to a liquid state. Helium-3 in the liquid state can collect in sealed pot 570. When thermal switches 591, 593, and 595 are each in the decoupling state, inlet port 579, inlet port 579 of pump 575 can be operated to reduce a pressure above the liquified helium-3 collected in sealed pot 570. Helium-3 in the gaseous state can form above the liquified helium-3 collected in sealed pot 570 through evaporation and flow to inlet port 579 of pump 575 via pumping line 574. Heat carried by the helium-3 in the gaseous state flowing through pumping line 574 can reduce a temperature of the liquified helium-3 remaining in sealed pot 570. Such evaporative cooling of the liquified helium-3 in sealed pot 570 can reduce a temperature of intermediate thermal stage 525 such that intermediate thermal stage 525 can operate at a temperature of about 300 mK.

Operating intermediate thermal stage 525 at a temperature of about 300 mK can also facilitate sectioning cryostat 500 into multiple cryogenic systems (e.g., enclosed thermal volume 550 and volume 545) operating at different temperatures within a common vacuum space. For example, cryostat 500 can further comprise additional thermal switches (not shown), such as a thermal switch intervening between intermediate thermal stage 525 and Cold Plate stage 530; and a thermal switch intervening between Cold Plate stage 530 and Mixing Chamber stage 535. In this example, each thermal switch intervening between intermedial thermal stage 525 and Mixing Chamber stage 535 can be transitioned to a coupling state. By transitioning those intervening thermal switches to the coupling state, Cold Plate stage 530 and Mixing Chamber stage 535 can be thermally equalized with intermediate thermal stage 525 to operate at a temperature of about 300 mK.

When thermal switches 591, 593, and 595 are each in the coupling state, inlet port 579 of pump 575 can be operated to maintain a pressure above the liquified helium-3 collected in sealed pot 570 at the common pressure of the common vacuum space. Maintaining the pressure above the liquified helium-3 collected in sealed pot 570 at the common pressure can impede evaporative cooling of the liquified helium-3 in sealed pot 570. Absent such evaporative cooling, intermediate thermal stage 525 can be thermally equalized with one or more higher temperature thermal stages of cryostat 500. For example, intermediate thermal stage 525 can be thermally equalized with 4-K stage 510 via the thermal paths provided by thermal switches 591, 593, and 595 such that intermediate thermal stage 515 can operate at a temperature of about 4 K. As another example, intermediate thermal stage 525 can be thermally equalized with intermediate thermal stage 515 via the thermal paths provided by thermal switches 593 and 595 such that intermediate thermal stage 525 can operate at a temperature of about 1 K. As another example, intermediate thermal stage 525 can be thermally equalized with Still stage 520 via the thermal path provided by thermal switch 595 such that intermediate thermal stage 525 can operate at a temperature of about 700 mK. In an embodiment, sealed pots 560 and/or 570 can be vacuum sealed or cryogenically sealed. In an embodiment, sealed pots 560 and/or 570 can comprise sintered material that facilitates thermal budget optimization. The sintered material can comprise silver, gold, copper, platinum, and the like.

Figure 6:
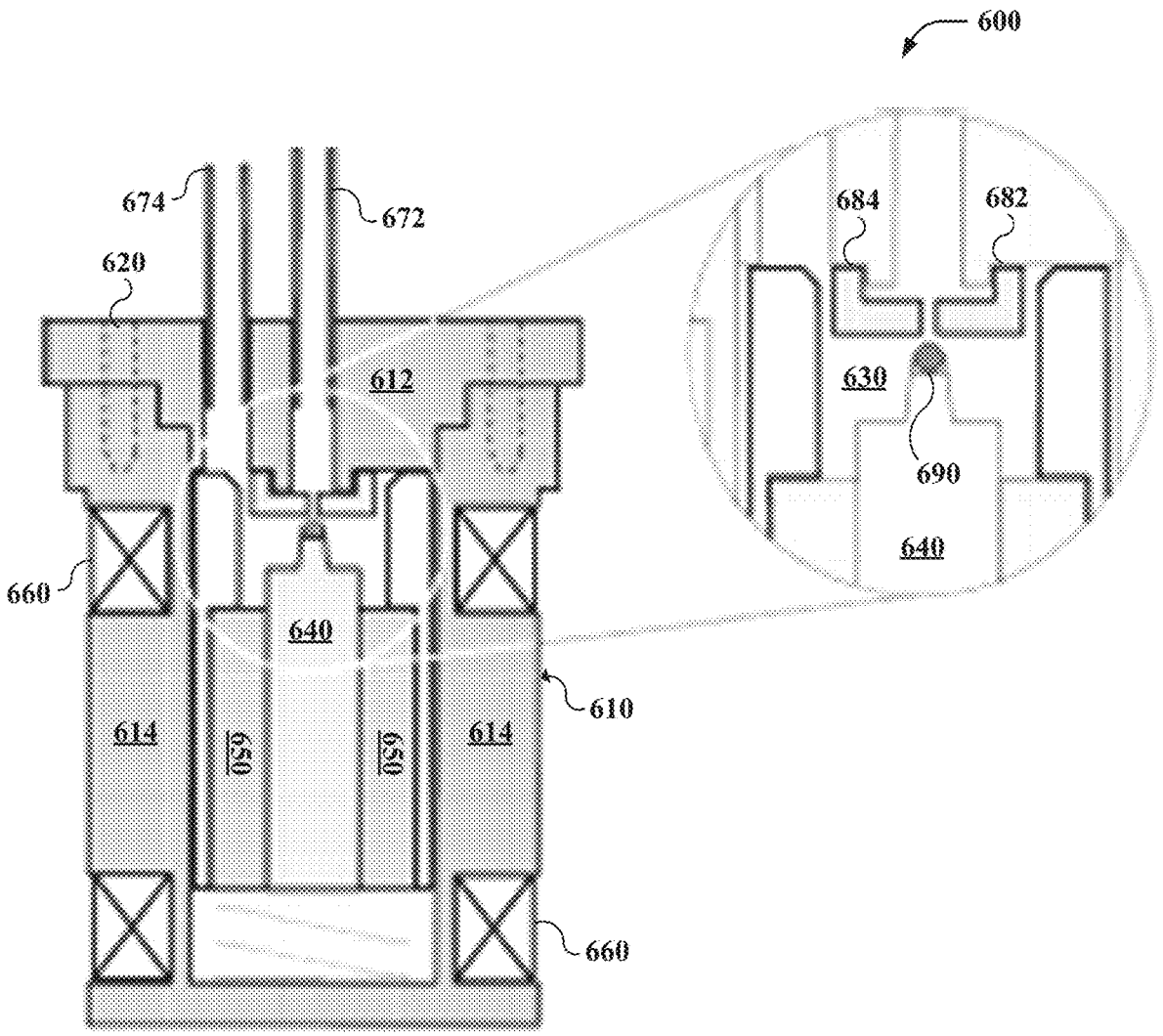
FIG. 6 illustrates an example, non-limiting thermal switch that facilitates a switchable thermal path in a coupling state, in accordance with one or more embodiments described herein.
Figure 7:
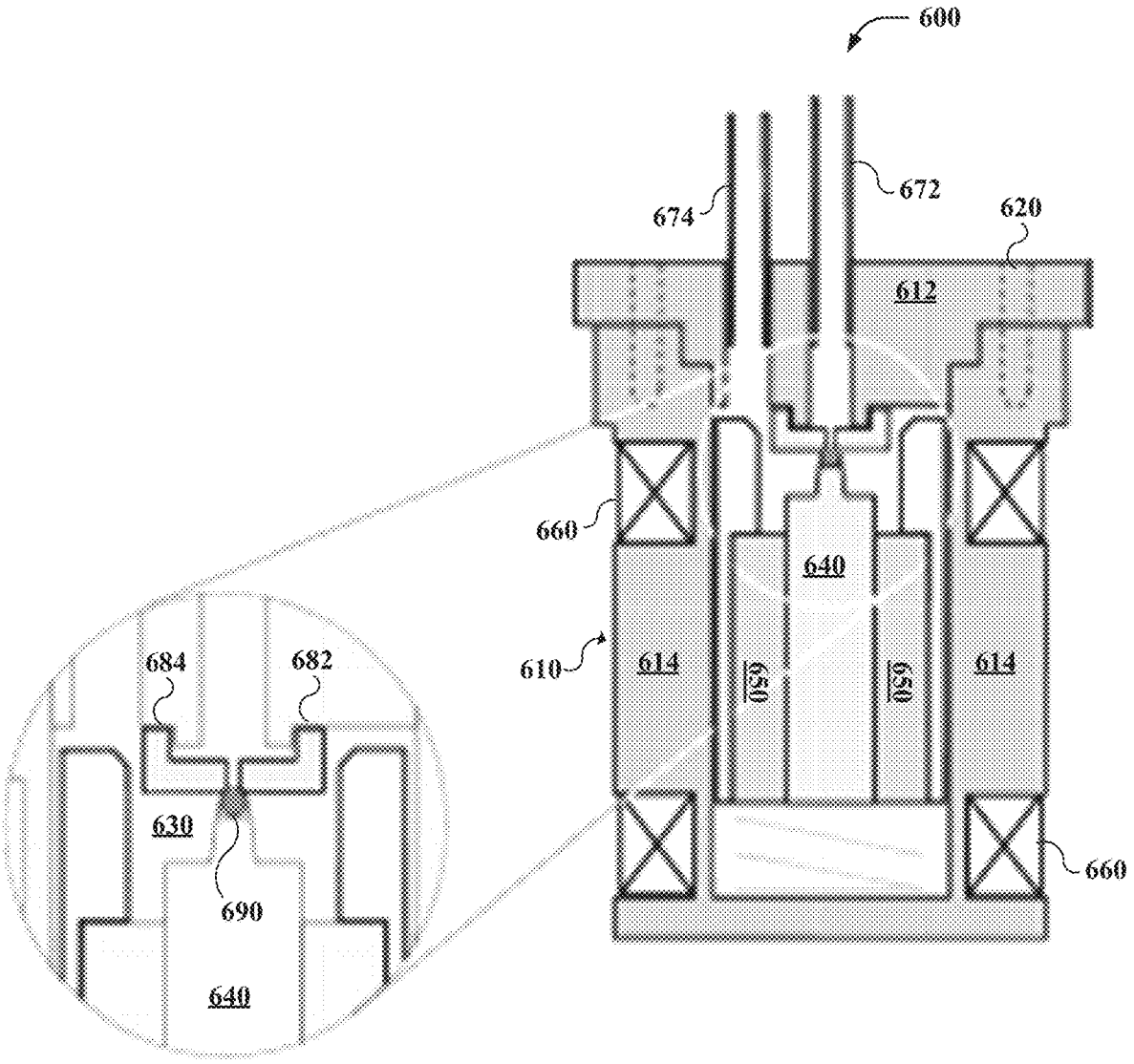
FIG. 7 illustrates the example, non-limiting thermal switch of FIG. 6 in a decoupling state.

FIGS. 6-7 illustrate an example, non-limiting thermal switch 600 that facilitates a switchable thermal path, in accordance with one or more embodiments described herein. As shown by FIGS. 6-7, thermal switch 600 comprises a housing 610 formed by coupling a top portion 612 with a bottom portion 614 define an interior volume 630 using attachment mechanisms 620. In FIGS. 6-7, attachment mechanisms 620 are illustrated as bolts. However, in other embodiment, different attachment mechanisms can be used to implement attachment mechanisms 620. For example, attachment mechanisms 620 can be implemented as weld joints that couple top portion 612 to bottom portion 614. Thermal switch 600 further comprises a piston 640 disposed within interior volume 630 and one or more permanent magnets 650 circumscribing piston 640. A Helmholtz coil system can be formed by circumscribing bottom portion 614 with a pair of superconducting wires 660. The Helmholtz coil system can interact with the one or more permanent magnets 650 circumscribing 640 to facilitate magnetic actuation of thermal switch 600.

In operation, a helium medium can be received into interior volume 630 via a capillary 672 coupled to an outlet port of a pump (not shown) when thermal switch 600 is in a coupling state shown by FIG. 6. While in the coupling state, helium medium within interior volume 630 can thermally couple adjacent thermal stages coupled to thermal switch 600. Thermal switch 600 can transition from the coupling state shown by FIG. 6 to a decoupling state shown by FIG. 7 by applying an electrical signal to the pair of superconducting wires 660 forming the Helmholtz coil system. As shown by FIG. 7, applying the electrical signal to the pair of superconducting wires 660 forming the Helmholtz coil system can bring a ruby bead 690 in contact with a polymer seat 680. Bringing the ruby bead 690 in contact with polymer seat 680 can prevent further ingress of the helium medium into interior volume 630. In an embodiment, polymer seat 680 comprises polyamide-imide. As further ingress of the helium medium into interior volume 630 is prevented, an inlet port of the pump (not shown) can remove residual helium medium from interior volume 630 via capillary 674 to thermally decouple the adjacent thermal stages coupled to thermal switch 600. In an embodiment, the helium medium can be helium-4. In this embodiment, thermal switch 600 can be a magnetically actuated superfluid leak tight valve. In an embodiment, the helium medium can be helium-3. In this embodiment, thermal switch 600 can be a magnetically actuated fluid leak tight valve.

Figure 8:
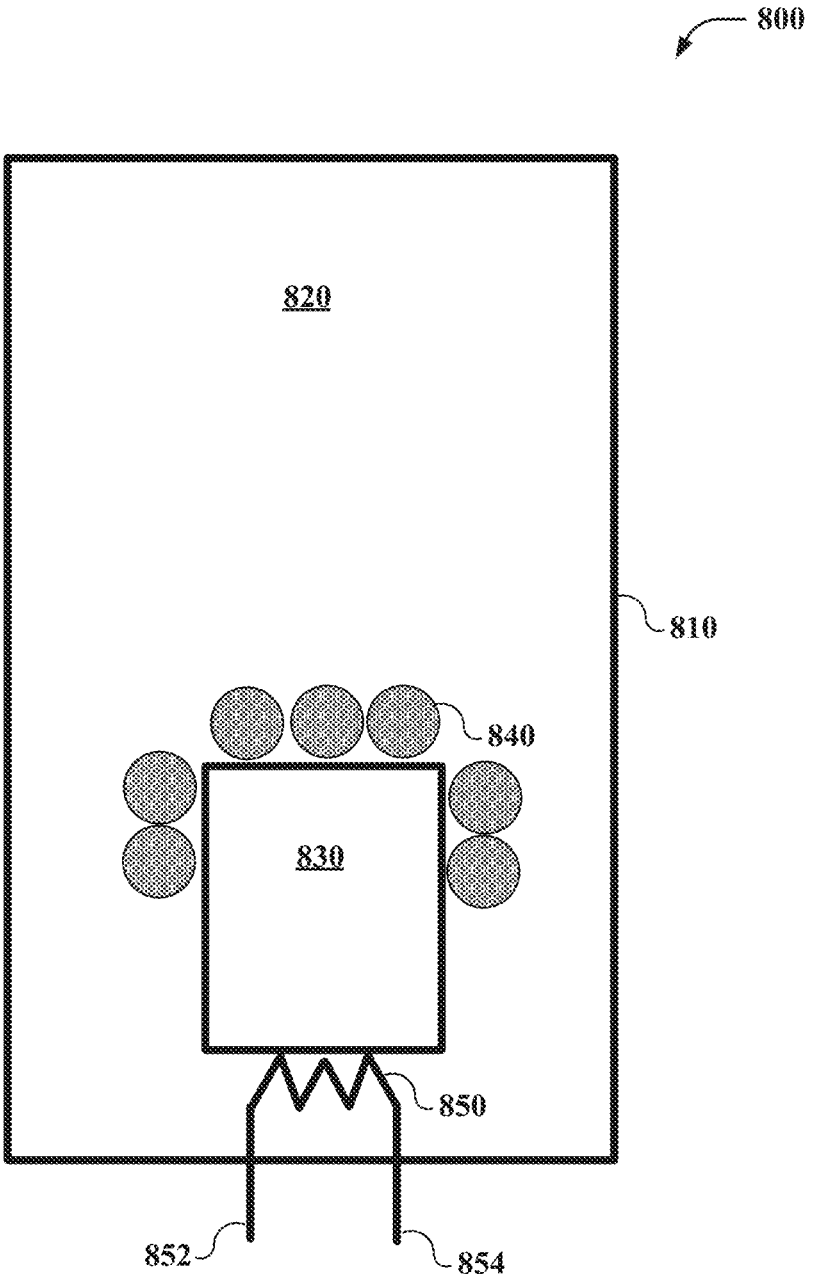
FIG. 8 illustrates another example, non-limiting thermal switch that facilitates a switchable thermal path, in accordance with one or more embodiments described herein.

FIG. 8 illustrates another example, non-limiting thermal switch 800 that facilitates a switchable thermal path, in accordance with one or more embodiments described herein. Thermal switch 800 comprises a metal object 830 disposed within an interior volume 820 defined by a sealed container 810. In an embodiment, metal object 830 can comprise brass. In an embodiment, sealed container 810 can comprise stainless steel. As shown by FIG. 8, one or more charcoal pellets 840 and a heating element 850 can be coupled to metal object 830. In an embodiment, the one or more charcoal pellets 840 and/or heating element 850 can be coupled to metal object 830 using an epoxy.

Interior volume 820 of sealed container 810 can comprise a helium medium. In an embodiment, the helium medium can be introduced into the interior volume 820 of sealed container 810 at room temperature. In an embodiment, the helium medium can be introduced into the interior volume 820 of sealed container 810 via a valve (not shown) disposed within a wall of sealed container 810. In an embodiment, the helium medium can be introduced into the interior volume 820 of sealed container 810 at a pressure of about 10 millibar. As a temperature within the interior volume 820 of sealed container 810 falls below 10 K, charcoal pellets 840 can remove the helium medium from the interior volume 820 by absorbing the helium medium. In an embodiment in which the helium medium is helium-4, charcoal pellets 840 can efficiently remove the helium medium from the interior volume 820 when the temperature within interior volume 820 falls below 4.2 K. In an embodiment in which the helium medium is helium-3, charcoal pellets 840 can efficiently remove the helium medium from the interior volume 820 when the temperature within interior volume 820 falls below 3.1 K. Removing the helium medium from the interior volume 820 through absorption by charcoal pellets 840 transitions thermal switch 800 into a decoupling state. In the decoupling state, adjacent thermal stages coupled to thermal switch 800 are thermally decoupled. An electrical signal can be applied to heating element 850 via conducting elements 852 and 854. Heat generated by heating element 850 can be applied to charcoal pellets 840 via metal object 830. Application of heat to charcoal pellets 840 can release the helium medium that the charcoal pellets 840 absorbed into interior volume 820, thereby transitioning thermal switch 800 from the decoupling state to a coupling state. In the coupling state, the adjacent thermal stages coupled to thermal switch 800 are thermally coupled.

Embodiments of the present invention may be a system, a method, and/or an apparatus at any possible technical detail level of integration. What has been described above includes mere examples of systems, methods, and apparatus. It is, of course, not possible to describe every conceivable combination of components or computer-implemented methods for purposes of describing this disclosure, but one of ordinary skill in the art can recognize that many further combinations and permutations of this disclosure are possible. Furthermore, to the extent that the terms "includes," "has," "possesses," and the like are used in the detailed description, claims, appendices and drawings such terms are intended to be inclusive in a manner similar to the term "comprising" as "comprising" is interpreted when employed as a transitional word in a claim.

In addition, the term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. Moreover, articles "a" and "an" as used in the subject specification and annexed drawings should generally be construed to mean "one or more" unless specified otherwise or clear from context to be directed to a singular form. As used herein, the terms "example" and/or "exemplary" are utilized to mean serving as an example, instance, or illustration. For the avoidance of doubt, the subject matter disclosed herein is not limited by such examples. In addition, any aspect or design described herein as an "example" and/or "exemplary" is not necessarily to be construed as preferred or advantageous over other aspects or designs, nor is it meant to preclude equivalent exemplary structures and techniques known to those of ordinary skill in the art.

The descriptions of the various embodiments have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

While certain example embodiments have been described, these embodiments have been presented by way of example only, and are not intended to limit the scope the disclosures herein. Thus, nothing in the foregoing description is intended to imply that any particular feature, characteristic, step, module, or block is necessary or indispensable. Indeed, the novel methods and systems described herein may be embodied in a variety of other forms; furthermore, various omissions, substitutions and changes in the form of the methods and systems described herein may be made without departing from the spirit of the disclosures herein. The accompanying claims and their equivalents are intended to cover such forms or modifications as would fall within the scope and spirit of certain of the disclosures herein.

What is claimed is:

1. A cryostat, comprising:

a plurality of thermal stages [7,8] intervening between a 4-Kelvin (K) stage [6] and a Cold Plate stage [9], the plurality of thermal stages including a Still stage [7] and an intermediate thermal stage [8] that is directly coupled mechanically to the 4-K stage via a first support rod and directly coupled mechanically to the Still stage [7] via a second support rod wherein the first support rod is distinct from the second support rod; and a thermal switch [12] coupled to the intermediate thermal stage [8] and an adjacent thermal stage [7], wherein the thermal switch facilitates modifying a thermal profile of the cryostat by providing a switchable thermal path between the intermediate thermal stage and the adjacent thermal stage.

2. The cryostat of claim 1, wherein the plurality of thermal stages is enclosed in an outer vacuum chamber defining a common vacuum space.

3. The cryostat of claim 1, wherein the intermediate thermal stage operates at a temperature of about 300 millikelvin (mK) or about 1 kelvin (K).

4. The cryostat of claim 1, wherein the thermal switch is a magnetically actuated superfluid leak tight valve.

5. The cryostat of claim 1, wherein the adjacent thermal stage is the Still stage or the 4-K stage.

6. The cryostat of claim 1, further comprising:

an additional thermal switch coupled to the 4-K stage that facilitates modifying the thermal profile of the cryostat by providing an additional switchable thermal path between the 4-K stage and the intermediate thermal stage, wherein the thermal switch and the additional thermal switch are coupled to opposing sides of the intermediate thermal stage.

7. The cryostat of claim 1, wherein the thermal switch comprises a superconducting material positioned within a magnetic field.

8. The cryostat of claim 1, wherein the thermal switch comprises a capillary that receives a helium medium.

9. The cryostat of claim 8, wherein the helium medium is helium-3 or helium-4.

10. The cryostat of claim 8, wherein the helium medium thermally shorts the intermediate thermal stage to the adjacent thermal stage.

11. The cryostat of claim 1, wherein the intermediate thermal stage provides passage to a pumping line that couples a pump and a sealed pot of an additional intermediate thermal stage that facilitates evaporation of helium-3.

12. A cryostat comprising:

a Still stage directly coupled mechanically to an intermediate thermal stage via a support rod, wherein the Still stage and the intermediate thermal stage are included among a plurality of thermal stages intervening between a 4-Kelvin (K) stage and a Cold Plate stage; and a thermal switch coupled to the intermediate thermal stage and an adjacent thermal stage, wherein the thermal switch facilitates modifying a thermal profile of the cryostat by providing a switchable thermal path between the intermediate thermal stage and the adjacent thermal stage, wherein the Still stage is positioned external to an enclosed thermal volume.

13. The cryostat of claim 12, further comprising:

a thermal shield coupled to the intermediate thermal stage that forms the enclosed thermal volume.

14. The cryostat of claim 13, wherein the Still stage is positioned within the enclosed thermal volume.

15. The cryostat of claim 13, wherein the Cold Plate stage is positioned within the enclosed thermal volume.

16. The cryostat of claim 13, further comprising:

an additional enclosed thermal volume nested within the enclosed thermal volume, wherein the additional enclosed thermal volume is formed by an additional intermediate thermal stage coupled to an additional thermal shield, and wherein the additional intermediate thermal stage is included among the plurality of thermal stages.

17. A cryostat comprising:

an enclosed thermal volume formed by an intermediate thermal stage coupled to a thermal shield, wherein the intermediate thermal stage is directly coupled mechanically to a Still stage via a support rod, and wherein the Still stage and the intermediate thermal stage are included among a plurality of thermal stages intervening between a 4-Kelvin (K) stage and a Cold Plate stage;

a thermal switch coupled to the intermediate thermal stage and an adjacent thermal stage, wherein the thermal switch facilitates modifying a thermal profile of the cryostat by providing a switchable thermal path between the intermediate thermal stage and the adjacent thermal stage, wherein the adjacent thermal stage is the 4-K stage.

18. The cryostat of claim 17, wherein the enclosed thermal volume is nested within an additional enclosed thermal volume formed by an additional intermediate thermal stage coupled to an additional thermal shield, and wherein the additional intermediate thermal stage is included among the plurality of thermal stages.

19. The cryostat of claim 18, wherein the additional enclosed thermal volume is enclosed within a common vacuum space defined by an outer vacuum chamber of the cryostat.

20. The cryostat of claim 17, wherein a Mixing Chamber stage of the cryostat is positioned within the enclosed thermal volume.

* * * * *